US009155361B2

(12) United States Patent
Iten

(10) Patent No.: US 9,155,361 B2
(45) Date of Patent: Oct. 13, 2015

(54) MECHANICAL LEVER BUCKLE FOR BELT AND WATCH STRAP

(75) Inventor: Roland Iten, Le Mont-sur-Lausanne (CH)

(73) Assignee: ROLAND ITEN MECHANICAL LUXURY SA, Le Mont-sur-Lausanne (CH)

( * ) Notice: Subject to any disclaimer, the term of this patent is extended or adjusted under 35 U.S.C. 154(b) by 65 days.

(21) Appl. No.: 14/000,337

(22) PCT Filed: Feb. 27, 2012

(86) PCT No.: PCT/IB2012/050884
§ 371 (c)(1),
(2), (4) Date: Oct. 28, 2013

(87) PCT Pub. No.: WO2012/117326
PCT Pub. Date: Sep. 7, 2012

(65) Prior Publication Data

US 2014/0075723 A1 Mar. 20, 2014

(30) Foreign Application Priority Data

Feb. 28, 2011 (CH) ..... 0338/11

(51) Int. Cl.
*A44B 11/22* (2006.01)

(52) U.S. Cl.
CPC ..... *A44B 11/226* (2013.01); *A44B 11/22* (2013.01); *Y10T 24/4077* (2015.01)

(58) Field of Classification Search
CPC ..... F16M 13/04; F16M 11/041; F16M 13/00; A44B 11/25; A44B 11/258; A44B 11/2592; A44B 11/223; A44B 11/22; A44B 11/226; A44C 5/246; Y10T 24/4077
USPC ..... 24/163 K, 178, 179, 191
See application file for complete search history.

(56) References Cited

U.S. PATENT DOCUMENTS 91,390 A * 6/1869 Welker ..... 24/180
146,495 A * 1/1874 Walker ..... 24/166
(Continued)

FOREIGN PATENT DOCUMENTS

CH 700 607 A2 9/2010
DE 201 04 382 5/2001
(Continued)

OTHER PUBLICATIONS

International Search Report prepared by the European Patent Office on Oct. 10, 2012, for International Application No. PCT/IB2012/050884.
(Continued)

*Primary Examiner* — Victor Batson
*Assistant Examiner* — David Upchurch
(74) *Attorney, Agent, or Firm* — Sheridan Ross P.C.

(57) ABSTRACT

A mechanical lever buckle having a buckle base plate, a lever element, a buckle prong and a belt loop element having a belt guiding element for guiding a belt in a belt guiding direction is disclosed. The buckle base plate includes an elongated slit oriented in the belt guiding direction. The lever element includes an elongated guiding opening that allows passage of at least a portion of the buckle prong. The lever element is attached to the buckle base plate at a first rotation axis, such that during rotation the elongated guiding opening intersects at all time with the elongated slit and the buckle prong slides along the slit and the elongated guiding opening. The lever element includes a lever tooth that interacts with a belt loop tooth when the lever element is rotated to the determined angle of rotation to block a belt loop element's movement.

9 Claims, 4 Drawing Sheets

(56) References Cited

U.S. PATENT DOCUMENTS

| | | | | |
|---|---|---|---|---|
| 3,965,545 | A * | 6/1976 | Johansson | 24/186 |
| 4,232,428 | A * | 11/1980 | Johansson | 24/188 |
| 4,369,529 | A | 1/1983 | Yahata | |
| 4,891,866 | A * | 1/1990 | Kasai | 24/170 |
| 5,127,136 | A * | 7/1992 | Magnus | 24/176 |
| 6,353,977 | B1 * | 3/2002 | Hagmann | 24/71 J |
| 2004/0135361 | A1 * | 7/2004 | Walenta | 280/806 |
| 2006/0080811 | A1 * | 4/2006 | Grimm | 24/615 |
| 2008/0148527 | A1 * | 6/2008 | Iten | 24/3.1 |
| 2009/0151131 | A1 * | 6/2009 | Schultz | 24/163 R |
| 2012/0073093 | A1 * | 3/2012 | Szellos | 24/594.1 |
| 2012/0222270 | A1 * | 9/2012 | Schultz | 24/303 |

FOREIGN PATENT DOCUMENTS

| | | | |
|---|---|---|---|
| FR | 424 090 | A | 5/1911 |
| FR | 1 570 595 | A | 6/1969 |

OTHER PUBLICATIONS

Written Opinion prepared by the European Patent Office on Oct. 10, 2012, for International Application No. PCT/IB2012/050884.

* cited by examiner

PRIOR ART

PRIOR ART

MECHANICAL LEVER BUCKLE FOR BELT AND WATCH STRAP

CROSS REFERENCE TO RELATED APPLICATIONS

This application is a national stage application under 35 U.S.C. 371 and claims the benefit of PCT Application No. PCT/IB2012/050884 having an international filing date of 27 Feb. 2012, which designated the United States, and which PCT application claimed the benefit of Swiss Application No. 00338/11 filed 28 Feb. 2011, the disclosure of which is incorporated herein by reference.

TECHNICAL FIELD

The present invention relates to a mechanical buckle that may be used for a belt and a watch strap.

BACKGROUND ART

A belt or watch strap generally comprises two parts: a buckle and a leather belt. The belt itself may also be made out of materials other than leather. In the case of the watch strap, this comprises a leather strap rather than the leather belt, whereby this may also be made out of materials other than leather.

FIG. 1A shows an example buckle 2 from prior art which comprises a belt clip 1 and a conventional buckle prong 3. The buckle 2 further comprises a belt loop 4 and a belt beginning cavity 7. The buckle prong 3 is ended at its end opposite from the buckle 2 by a stopper element 31.

FIG. 1B illustrates the buckle 2 attached at a belt beginning 52 of a belt 5. The belt beginning 52 is positioned in the belt beginning cavity 7 and secured by the belt clip 1 which is rotated into a locking position. A belt ending 51 of the belt 5 is inserted by sliding into the belt loop 4. The belt 5 comprises in a portion proximate the belt ending 51 a number of belt holes 53, whereby at least one of the belt holes 53 at the time may be positioned relative to the buckle 2 such that the conventional buckle prong 3 and its stopper element 31 are inserted into it.

It is understood that the belt 5 should be replaced by a strap (not shown in FIGS. 1A and 1B in case the buckle 2 is used for a watch strap. The use of the strap has no influence on the manner in which the buckle 2 is used, and thus the belt 5 and the strap are fully interchangeable.

FIGS. 2A and 2B show the buckle 2 respectively in open and closed positions. In FIG. 2A, the buckle 2 is in the open position such that the conventional buckle prong 3 and its stopper element 31 are positioned to be inserted into one of the belt holes 53. In FIG. 2B the conventional buckle prong 3 and its stopper element 31 have been pushed into the one of the belt holes 53 by bringing the buckle 2 closer to the concerned belt hole 53.

FIGS. 3A and 3B show the buckle 2 respectively in open and closed positions in use with a worn out example of the belt 5. The fact that the belt 5 is worn out may be seen at the sizes of the belt holes 53 which are generally larger than the sizes of the corresponding belt holes 53 seen in FIGS. 1A, 1B, 2A and 2B. While in the latter 4 figures the belt holes 53 are dimensioned such that walls of the belt hole 53 into which the conventional buckle prong 3 has completely been inserted, enter in intimate contact with the convention buckle prong 3, on the contrary in FIGS. 3A and 3B the walls of the belt hole 53 into which the conventional buckle prong 3 is completely inserted do not anymore have intimate contact on the whole circumference of the belt hole 53 with the conventional buckle prong 3.

The wear of the belt holes 53 occurs has a result of a prolonged use of the belt 5 together with the buckle 2, during which the conventional buckle prong 3 is repeatedly inserted and removed from one belt hole 53 at a time, and during which also a continuous tension of the belt 5 on the inserted conventional buckle prong 3 may be exerted while the belt is being worn by a user (not shown in the figures). As a result of the wear of the belt holes 53, the conventional buckle prong 3 may more easily be released and exit the belt hole 53 in which it is meant to remain inserted, hence allowing the buckle 2 to open in an unwanted manner and the belt 5 to fail in its function. Moreover the buckle 2 causes a wear of the belt holes 53 which may be considered excessive when compared to an overall wear of the belt 5.

The invention aims to address the problems encountered with the buckle from prior art when used with a belt or a watch strap.

SUMMARY OF INVENTION

The invention provides a mechanical lever buckle that comprises a buckle base plate, a buckle prong and a belt loop element having a belt guiding means allowing to guide a belt in a belt guiding direction. The lever buckle further comprises a lever element. The buckle base plate comprises an elongated slit operated in the plate with a direction of the elongation slit corresponding to the belt guiding direction, having a first width that allows to pass through at least a portion of the buckle prong and to slide the buckle prong in belt guiding direction of the slit. The lever element comprises an elongated guiding opening having a second width that allows to pass through at least a portion of the buckle prong and to slide the buckle prong in a first length direction of the guiding opening. The lever element is attached to the buckle base plate at a first of lever's element's extremities around a first rotation axis that has a direction passing through the buckle base plate, such that it may rotate around the first rotation axis while during rotation the elongated guiding opening intersects at all time the slit and such that during rotation the buckle prong slides along the slit and the elongated guiding opening. The belt loop element is movably fixed to the buckle base plate and comprises a belt loop tooth that allows to block any belt loop element's movement relative to the buckle base plate. The lever element comprises a lever blocking means that interacts with counter part lever fixing means of the buckle base plate to block the lever element at a determined angle of rotation, and a lever tooth that is integral with the lever element. The lever tooth interacts with the belt loop tooth when the lever element is rotated to the determined angle of rotation to block the any belt loop element's movement.

In a first preferred embodiment the counter part lever fixing means of the buckle base plate comprises a plurality of lever wheels mounted along a border of the buckle base plate, the lever blocking means engaging with one of the plurality of lever wheels to block the lever element.

In a second preferred embodiment the belt loop element is movably fixed to the buckle base plate with rotation axis means allowing to rotate the belt loop element around a second rotation axis that is perpendicular to the belt guiding direction.

In a third preferred embodiment the buckle prong comprises a top wheel rotatably mounted on an end of the buckle prong in order to reduce any friction that occurs when the buckle prong slides in the guiding opening.

In a fourth preferred embodiment the buckle prong comprises a rotatable element that rotates around a prong axis directed in the length direction of the buckle prong and allows to more easily move the slidable buckle prong along the elongated slit.

In a fifth preferred embodiment the mechanical lever buckle further comprises a reader positioned in the elongated slit and through which the buckle prong passes, whereby the reader allows to more easily slide the buckle prong on a side of the buckle base plate facing the belt loop element, when the belt loop element is blocked in its movement relative to the buckle base plate.

BRIEF DESCRIPTION OF THE FIGURES

The invention is discussed below in reference to features illustrated in the following figures.

DESCRIPTION OF EXAMPLE EMBODIMENTS

The following is a description of example embodiments that will allow to more precisely understand various aspects of the invention. The description will be made in reference to the figures, whereby same reference numbers will be used to refer to similar features that appear throughout the figures.

FIGS. 4A to 4D illustrate an example embodiment of a mechanical lever belt buckle 400 in a side view perspective and according to the invention. The belt buckle 400 may indifferently be used for a belt or for a watch strap. In the present description the description will be given in reference to the belt, but it is understood that the belt could well be swapped for the watch strap without any substantive changes other perhaps than adapting the sizes of features in accordance with the belt's or watch strap's width and/or thickness.

Figure 4A:
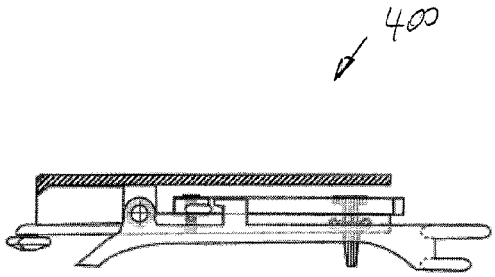
FIGS. 4A-4D show an example embodiment of a belt buckle in side view with or without a belt according to the invention.
Figure 4B:
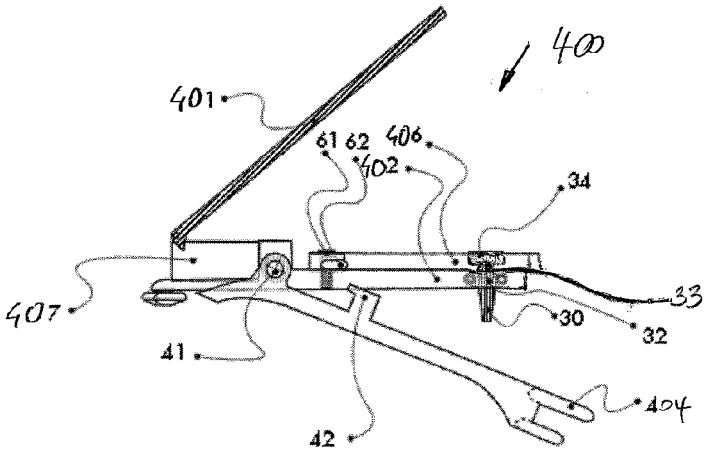
Figure 4C:
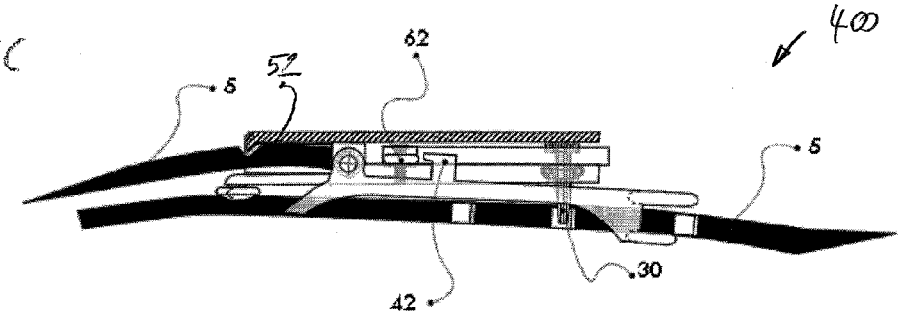
Figure 4D:
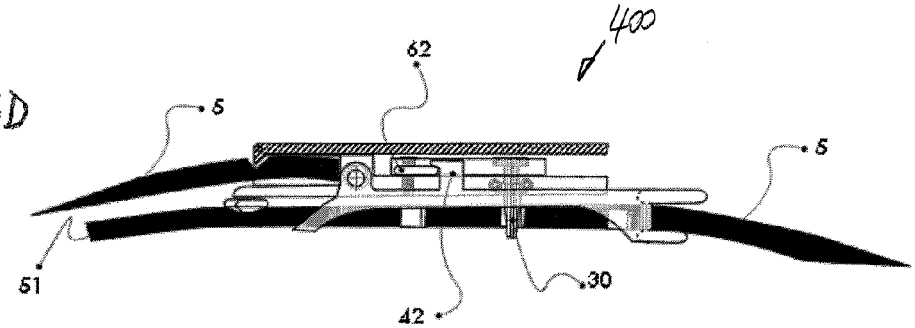

FIGS. 4A and 4B show the belt buckle 400 in closed and opened positions respectively. FIGS. 4C and 4D show the belt buckle 400 in the closed position when mounted to the belt 5.

Figure 1B:
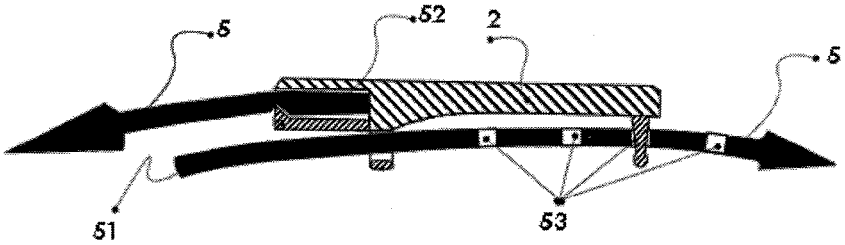
FIGS. 1A and 1B show a buckle as known from prior art.
Figure 1A:
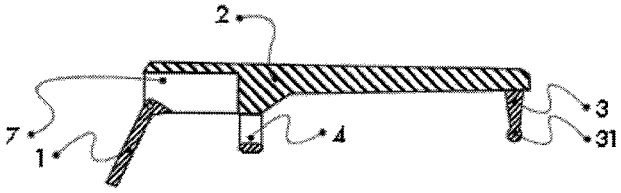
Fig. 1A PRIOR ART
Figure 2A:
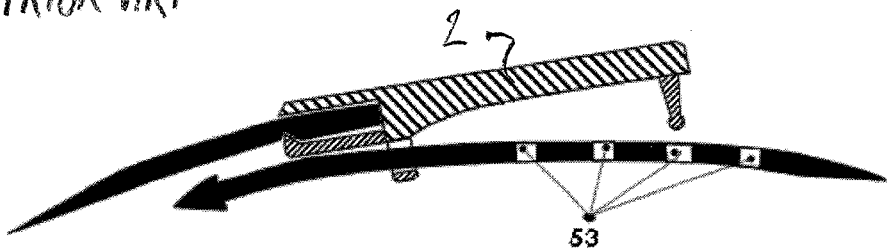
FIGS. 2A and 2B show the buckle in an open and closed position with a belt, according to prior art.
Figure 2B:
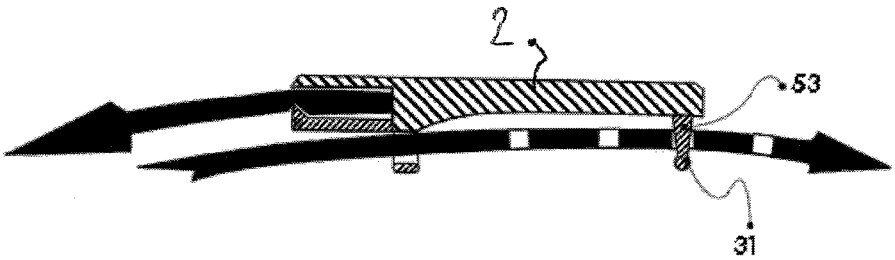
Figure 3A:
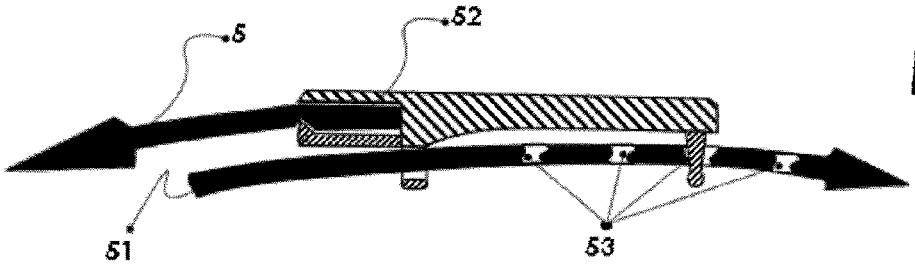
FIGS. 3A and 3B show the buckle in an open and closed position with a belt in which the belt holes are worn out according to prior art.
Figure 3B:
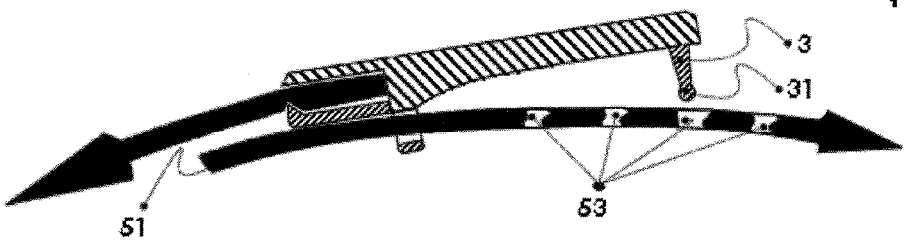

An upper belt clip 401 allows to secure the belt beginning 52 of the belt 5 in the belt beginning cavity 407 by being rotated into a locking position. The locking position of the upper belt clip 401 is shown in FIG. 4A for the belt buckle 400 alone, and in FIGS. 4C and 4D for the belt buckle 400 when the belt beginning 52 is inserted into the belt beginning cavity 407. The upper belt clip 401 may be used as a support for decorative motives that may be engraved, embossed or otherwise apposed on one or more surfaces thereof. When compared to the prior art buckle 2 illustrated in FIG. 1A, the upper belt clip 401 is comparatively longer than the belt clip 1 and therefore provides a superior lever force which makes it easier to lock the belt beginning 52 in the beginning cavity 407.

As shown in FIG. 4B, the belt buckle 400 further comprises a buckle base plate 402, a slidable buckle prong 30, a lever element 406 and a belt loop element 404. One noticeable difference with the buckle prong 3 from prior art, is that the slidable buckle prong 30 ends without the stopper element 31. The absence of the stopper element 31 makes is easier to insert the slidable buckle prong 30 into one of the belt holes of the belt 5.

Figure 5A:
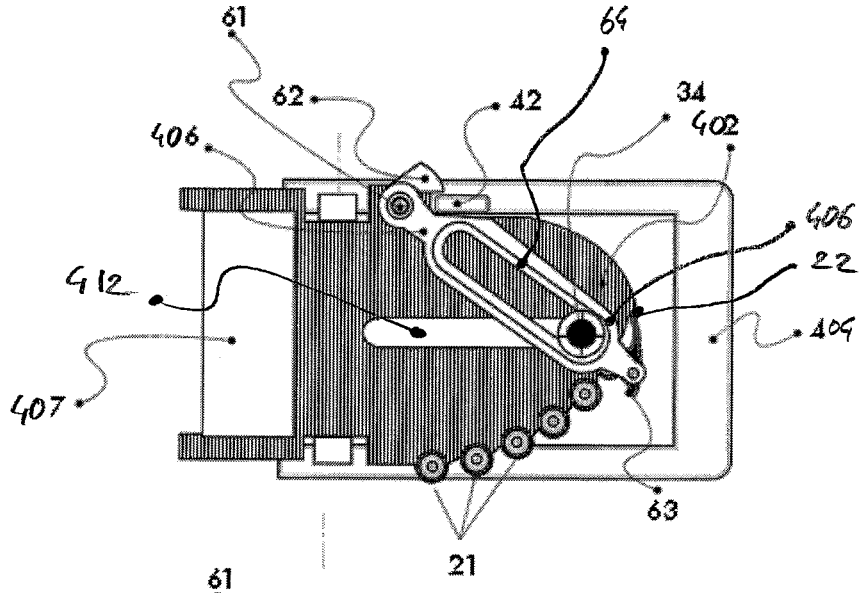
FIGS. 5A and 5B show the example embodiment of the belt buckle in a top side perspective, according to the invention.
Figure 5B:
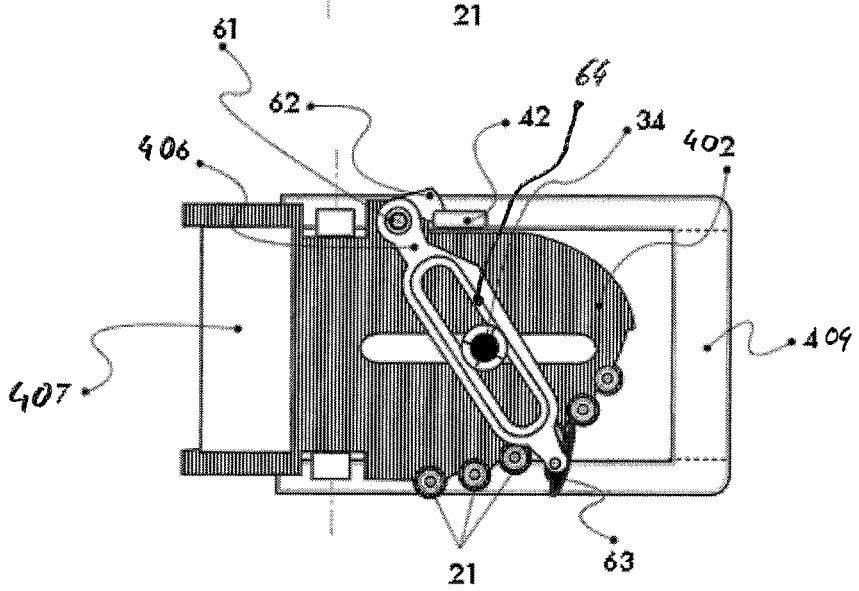

FIGS. 5A and 5B show the belt buckle from a top side perspective, wherein the buckle base plate 402 partly covers the belt loop element 404. The buckle base plate 402 comprises a slit 412 into which the slidable buckle prong 30 may slide depending on an angle that the lever element 406 takes with respect to the slit 412. The sliding of the slidable buckle prong 30 on a side of the buckle base 402 facing the belt loop element 404 is made easier by a reader 32 that can best be seen in FIG. 4B. The slidable buckle prong 30 also comprises a rotatable element 33 that rotates around an axis directed in the length direction of the slidable buckle prong 30 and allows to more easily move the slidable buckle prong 30 along the slit 412. In the embodiment as illustrated in FIG. 4B the length direction of the slidable buckle prong 30 is generally perpendicular to a surface of the buckle base plate 402. The slidable buckle prong 30 further comprises a top wheel 34 rotatably mounted on an end of the slidable buckle prong 30 in order to reduce any friction that occurs when the slidable buckle prong 30 slides in a guiding opening 64 comprised in the lever element 406 along its length direction. The top wheel 34 and the guiding opening 64 may for example be seen in FIGS. 5A and 5B.

The belt loop element 404 allows to guide the belt 5 along the buckle base plate 402 in such a manner to position a belt hole of the belt 5 in proximity of the slidable buckle prong 30. The belt loop element 404 is rotatably mounted to the buckle base plate 402 by means one or more rotation axis elements 41. The belt loop element 404 may be rotated from an open position shown in FIG. 4B to a closed position shown in FIG. 4A or in FIG. 4C, whereby in the closed position it is rotated to be positioned nearer to the buckle base plate 402, and in case a belt 5 is inserted into the belt loop element 404 the slidable buckle prong 30 may enter a belt hole. The belt loop element 404 comprises a belt loop tooth 42 that allows to releasably secure it in the closed position.

Referring now to FIGS. 4C and 4D and respective corresponding FIGS. 5A and 5B it is explained how the belt loop element 404 is secured in the closed position. Looking for example to FIG. 5A, the lever element 406 is rotatable around an axis 61 that is generally perpendicular to the buckle base plate 402. Hence the lever element 406 rotates in a plane that is parallel to the buckle base place 402. The lever element 406 further comprises a lever tooth 62 that is integrally mounted to it in vicinity of the axis 61 and rotates together with the lever element 406 to cooperate with the belt loop tooth 42 and secure the belt loop element 404 in the closed position. The lever element 406 comprises at one of its extremities opposed to the one where the axis 61 is located, a lever blocking element 63 which allows to block the lever element 406 at predetermined angles of rotation relative to the buckle base plate 402, whereby the lever tooth 62 blocks the belt loop tooth 42 in the locked position. The predetermined angles of rotation are defined by tooth wheels 21 that are mounted on a periphery of the buckle base plate 402 as can be seen in FIG. 5B. In an open position, wherein the lever tooth 62 releases the belt loop tooth 42, the lever blocking element 63 rests at a notch position 22 also located on the periphery of the buckle base plate 402 as can be seen in FIG. 5A.

In FIGS. 5A and 4C, the slidable buckle prong 30 is positioned at one extremity of the slit 412 towards the lever blocking element 63, whereby the latter rests at the notch position 22, and the belt loop element 404 may be freely rotated away from or towards the buckle base plate 402 since the belt loop tooth 42 is not blocked by lever tooth 62.

In FIGS. 5B and 4D, as compared with FIGS. 5A and 4C, the belt 5 is slid relative to the belt loop element 404 in the belt ending 51 direction. This moves the slidable buckle prong 30 in the slit 412, causes the lever element 406 to rotate and the lever blocking element to be blocked into a position corresponding to one of the tooth wheels 21 thereby making the lever tooth 62 block the belt loop tooth 42 in the locked position. The further the slidable buckle prong 30 is moved in the slit 412, the tighter the belt is adjusted to the user of the belt, or, in the case of a watch strap, the tighter the watch strap is made to fit around the wrist of the user.

The belt may be released by disengaging the lever blocking element 63 from the lever wheel 21 that it is engaged with. The lever element 406 is then allowed to rotate back towards the notch position 22, thereby making the slidable buckle prong 30 slide back to its initial position in the slit 412, and make the lever tooth 62 release the belt loop tooth 42. The belt loop element 404 may then be rotated away from the buckle base plate 402 and the belt 5 slid out of the belt loop element 404.

The belt buckle of the example embodiments described herein above allows to avoid an unwanted opening of the belt. Also, the wear that the buckle prong or other part of the belt buckle may cause on belt holes is considerably reduced as compared to prior art.

The use of the lever wheels 21 instead of conventional teeth to engage the lever blocking element 63 makes allows to substantially improve the wear resistance of the belt buckle.

While the invention has been described with the help of example embodiments and in reference to the figures, it is understood that the invention is only limited by the scope of the claims and that various features of the invention may be realized in different equivalent manners by a person skilled in the art while remaining in the scope of the claims.

The invention claimed is:

1. Mechanical lever buckle, comprising a buckle base plate;

a buckle prong; and a belt loop element having a belt guiding means allowing to guide a belt in a belt guiding direction;

characterized in that the mechanical lever buckle further comprises a lever element, whereby the buckle base plate comprises an elongated slit operated in the plate with a direction of the elongation slit corresponding to the belt guiding direction, having a first width that allows to pass through at least a portion of the buckle prong and to slide the buckle prong in belt guiding direction of the slit;

the lever element comprises an elongated guiding opening having a second width that allows to pass through at least a portion of the buckle prong and to slide the buckle prong in a first length direction of the guiding opening;

the lever element is attached to the buckle base plate at a first of the lever element's extremities around a first rotation axis that has a direction passing through the buckle base plate, such that it may rotate around the first rotation axis while during rotation the elongated guiding opening intersects at all time the slit and such that during rotation the buckle prong slides along the slit and the elongated guiding opening;

the belt loop element is movably fixed to the buckle base plate and comprises a belt loop tooth that allows to block any belt loop element's movement relative to the buckle base plate;

the lever element comprises a lever blocking means that interacts with counter part lever fixing means of the buckle base plate to block the lever element at a determined angle of rotation, and a lever tooth that is integral with the lever element;

the lever tooth interacts with the belt loop tooth when the lever element is rotated to the determined angle of rotation to block the any belt loop element's movement.

2. The mechanical lever buckle of claim 1, wherein the counter part lever fixing means of the buckle base plate comprise a plurality of lever wheels mounted along a border of the buckle base plate, the lever blocking means engaging with one of the plurality of lever wheels to block the lever element.

3. The mechanical lever buckle of claim 1, wherein the belt loop element is movably fixed to the buckle base plate with rotation axis means allowing to rotate the belt loop element around a second rotation axis that is perpendicular to the belt guiding direction.

4. The mechanical lever buckle of claim 1, wherein the buckle prong comprises a top wheel rotatably mounted on an end of the buckle prong in order to reduce any friction that occurs when the buckle prong slides in the guiding opening.

5. The mechanical lever buckle of claim 1, wherein the buckle prong comprises a rotatable element that rotates around a prong axis directed in the length direction of the buckle prong and allows to more easily move the slidable buckle prong along the elongated slit.

6. The mechanical lever buckle of claim 1, further comprising a reader positioned in the elongated slit and through which the buckle prong passes, whereby the reader allows to more easily slide the buckle prong on a side of the buckle base plate facing the belt loop element, when the belt loop element is blocked in its movement relative to the buckle base plate.

7. A belt comprising at least a buckle as defined in claim 1.

8. A watch strap comprising at least a buckle as defined in claim 1.

9. A watch in combination with a watch strap as defined in claim 8.

* * * * *